United States Patent [19]

Sumitomo

[11] 4,260,013

[45] Apr. 7, 1981

[54] PLATE TYPE HEAT EXCHANGER

[75] Inventor: Hiroyuki Sumitomo, Osaka, Japan

[73] Assignee: Hisaka Works, Limited, Osaka, Japan

[21] Appl. No.: 65,469

[22] Filed: Aug. 10, 1979

[51] Int. Cl.[3] ..... F28F 3/08

[52] U.S. Cl. ..... 165/75; 165/76; 165/145; 165/167

[58] Field of Search ..... 165/166, 167, 145, 76, 165/78, 75

[56] References Cited

U.S. PATENT DOCUMENTS

| | | | |
|---|---|---|---|
| 2,005,515 | 6/1935 | Winkler | 165/166 |
| 2,621,028 | 12/1952 | Newhall | 165/167 |
| 3,196,937 | 7/1965 | Jenssen | 165/166 |

FOREIGN PATENT DOCUMENTS

| | | | |
|---|---|---|---|
| 758439 | 4/1971 | Belgium | 165/166 |
| 54082 | 11/1903 | Fed. Rep. of Germany | 165/166 |
| 591577 | 4/1959 | Italy | 165/166 |
| 646468 | 10/1962 | Italy | 165/166 |
| 961419 | 6/1964 | United Kingdom | 165/166 |

*Primary Examiner*—Sheldon J. Richter

[57] ABSTRACT

A plate heat exchanger comprises a laterally arranged cylindrical container having an inlet and outlet for one of both media and those for the other medium and opening at one end, a plurality of heat exchange units each including a pair of opposite frames and a pack of plate elements therebetween and being inserted in sequence into the container, and a press lid attached to said one opening end of container under condition of thrusting said plurality of heat exchange units. The plate elements are clamped face to face through surrounding sealing surrounding sealing strips respectively to form between the plates interspaces through which the media flow. Every second interspace among the interspaces is closed with respect to the space within the container and communicates with said inlet and outlet for said one medium. The remaining interspaces open suitably with respect to the space within said container through partial cutouts at said sealing strips to thereby communicate with said inlet and outlet for said the other medium. Said one medium may be fluid medium and the other air medium and vice versa, which is determined by the ratio of flow rate of both media for heat exchange.

4 Claims, 12 Drawing Figures

PLATE TYPE HEAT EXCHANGER

BACKGROUND OF THE INVENTION

1. Field of the Invention

This invention relates to a plate heat exchanger, and more particularly to a plate heat exchanger of the so-called open type.

2. Description of the Prior Art

A plate heat exchanger comprises a pack of plate elements which are clamped face to face and form therebetween interspaces for the media to change heat with each other through the plate walls. These interspaces are isolated from each other by sealing strips which extend slightly internally of the outer periphery of each plate and surround the heat transfer surface thereof. Every sealing strip, when clamping the plates, is in sealing contact between the plates. At a pack of plates, every second interspace communicates with a supply of one of both the media while the remaining interspaces communicate with a supply of the other. Hence, at each interspace are provided an inlet and an outlet for the media.

The plate heat exchanger is classified into the closed type and open type. At the closed type plate heat exchanger, the most conventionally current type, a sealing strip surrounds an interspace between a pair of adjacent plates. A pack of plates form a series of closed chambers for each medium. On the other hand, at the open type plate heat exchanger, only every second interspace forms a closed chamber for one of the media by means of sealing strips or in another way, while the remaining interspaces for the other medium are open throughout or partially of the periphery of the interspace.

This invention relates to an open type plate heat exchanger. The well-known open type plate heat exchanger has chambers which are formed between a plurality of plates and are under conditions of allowing fluid to communicate with one another. These chambers collectively constitute a unit provided with an inlet and an outlet for one of the media, the unit being disposed within a container provided with an inlet and an outlet for the other. Hence, the other medium is freely accessible to the open interspaces between the plates from the space within the container.

Conventionally, this kind of heat exchanger, which has a number of plates inserted within the container and clamped face to face by means of bolts and nuts between the covering at the end of container and a thrust plate, is uneconomical due to need of enlarging the container in size to an extent of interference for clamping the plates, resulting in that the container occupies a surplus space for installation thereof. Furthermore, a number of confronting plates, when clamped at a single stroke from both end sides, are subjected to ununiform clamping stress, whereby the number of plates for use is limited to hinder improvement in the efficiency of the heat exchanger.

SUMMARY OF THE INVENTION

An object of the invention is to provide a plate heat exchanger comprising; a cylindrical container having an inlet and an outlet for one of both media to be heat-exchanged and an inlet and an outlet for the other and being arranged axially horizontally to open at one end; a plurality of heat exchange units including a pair of opposite frames and a pack of plate elements clamped face to face therebetween, and being inserted in sequence within the container; and a press lid attached to the opening end of container under condition of thrusting the plurality of heat exchange units.

In the present invention, the plates are fully clamped in assembly of each heat exchange unit prior to its insertion into the container. Hence, interference of the press lid corresponds to only a total amount of clearances possible to exist between each unit inserted in sequence within the container. As a result, the container, in its turn, the heat exchanger can as a whole be small-sized. The predetermined number of plates is clamped at the respective pair of frames so that when the processing capacity of heat exchanger is required to increase, it is enough to increase the number of heat exchange units, in which there is no inconvenience of applying ununiform stress to each clamped plate as conventional. By this, it is realizable to produce a large-sized heat exchange device corresponding to large capacity processing. Furthermore, there is the advantage in maintenance also, that is, dismantling, cleaning, repair and check of the plate are applicable by taking the units one by one out of the container at a desired place.

Each unit has the plates clamped face to face with each other between the pair of opposite frames through the surrounding sealing strips to thereby form interspaces through which the media flow. Among these interspaces, every second interspace is defined by sealing strips to be closed with respect to a space within the container and communicates with the inlet and outlet for the one medium. The remaining interspaces are open properly with respect to the space within the container through partial cutouts at the surrounding sealing strips and communicate with an inlet and outlet of the other medium. The heat exchanger of the invention, for the convenience of description below, treats heat exchange of air-to-fluid, where the one medium may be fluid medium and the other medium may be air and vice versa.

In the case that the one medium is fluid and the other is air, the fluid medium as aforegoing being supplied into the closed interspaces between the plates with respect to the space within the container, the air medium flowing from the space within the container into the open interspaces between the plates with respect to the space. Such the constitution meets the specifications such that a ratio of flow rate of air-to-air per unit area for heat transfer is larger, in other words, a flow rate of air is remarkably larger. Conversely, when a flow rate of fluid medium is remarkably larger, holes formed at the plates for introducing the fluid medium into and out of the closed interspaces occupy the plate surface area in a larger rate to thereby reduce the plate surface area to be utilized as the effective heat transfer surface. Under these conditions, the one medium is made fluid and the other, air to avoid the aforesaid drawback. In other words, the air medium is supplied into the closed interspaces between the plates and the fluid medium to the open interspaces between the plates. Consequently, the area of opening formed at the plates and serving to introduce steam into and out of the closed interspaces between the plates is enough to be relatively smaller, thereby ensuring the effective heat transfer area. Furthermore, in the heat exchanger of the invention, the opening area for introducing the media into and out of the open interspaces between the plates is readily adjustable by desirably changing the cutout length of sealing strip, whereby the flow rate of medium flowing through the open interspaces, consequently, the ratio of flow rate of both the media, can be readily set.

DESCRIPTION OF THE PREFERRED EMBODIMENTS

Figure 3B:
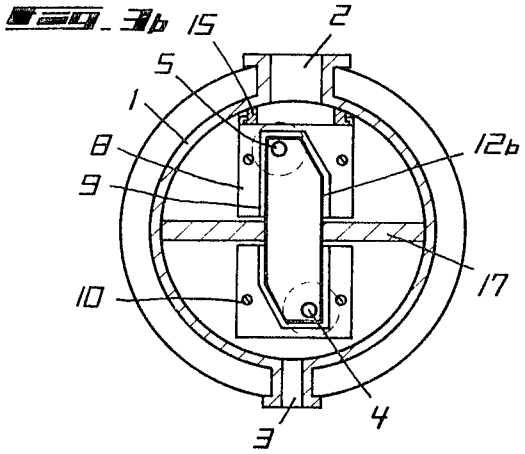
FIG. 3*b* is a sectional view of a closed interspace between the plates.

Referring to FIGS. 1, 2, 3*a* and 3*b*, the plate heat exchanger of the invention comprises; a horizontally arranged cylindrical container or housing (1) having a top inlet (2) for air medium, a bottom outlet (3) for condensate thereof, and at one end side an inlet (4) and an outlet (5) for fluid medium; and a plurality of heat exchange units (6) held properly within the housing (1) by a press lid (7) attached to an opening end of the housing (1). Each of the units (6) comprises a pair of opposite frames (8) and the predetermined number of rectangular heat-exchange plates (9) clamped therebetween by means of bolts (10) and nuts (11). The plates (9) interpose therebetween surrounding sealing strips (12*a*) and (12*b*) shown in the thick line and are clamped with each other, so that interspaces (A) and (B) are formed in alternate sequence between each plate (9) and receive both the media for heat exchange through the plate walls. In other words, a pack of plates (9) at the open type plate heat exchanger of the invention are so constituted that every second interspace (A), which opens with respect to the space within the housing (1) through cutouts in part of sealing strip (12*a*), communicates with the inlet (2) and outlet (3) for one of media, while, the remaining closed interspaces (B) each defined by the sealing strip (12*b*) between the plates (9) communicate with the inlet (4) and outlet (5) for the other.

Figure 4:
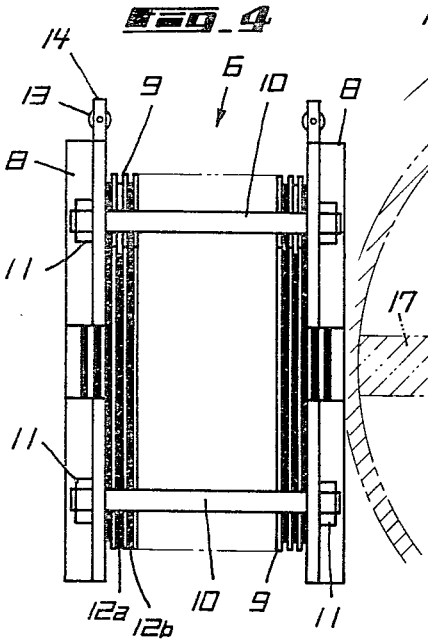
FIG. 4 is a view of one heat exchange unit.
Figure 5:
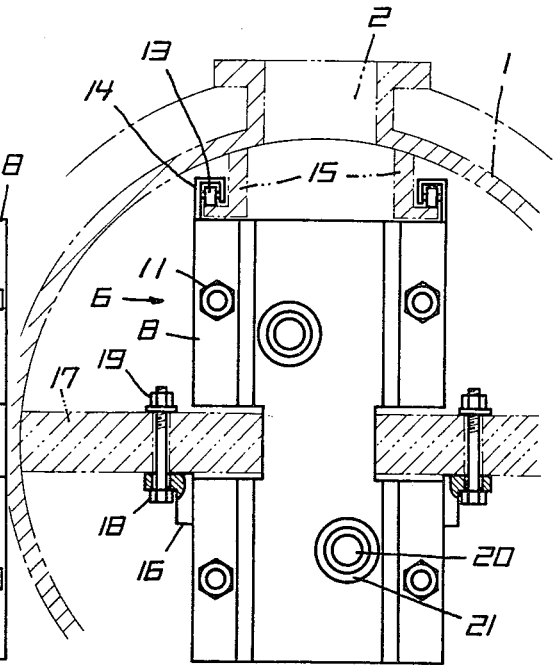
FIG. 5 is a side view thereof.
Figure 6:
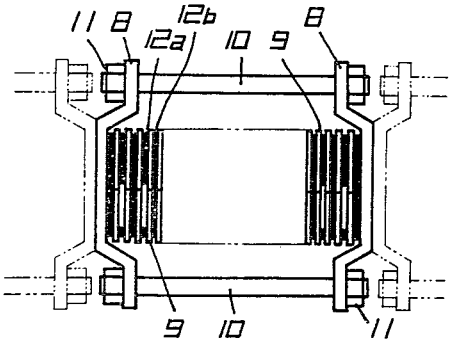
FIG. 6 is a plan view of the heat exchange unit in FIG. 4.
Figure 7:
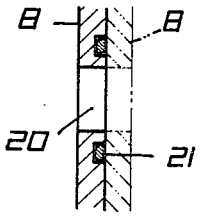
FIG. 7 is a sectional view of the principal portion of the frame of heat exchange unit.

Each unit (6), as shown in FIGS. 4 through 6, has rollers (13) pivoted to brackets (14) fixed to the upper ends of frames (8). The rollers (13) engage with guide bars (15) of each approximately L-like shape in section and formed at the upper inner wall of housing (1) lengthwise thereof to thereby facilitate insertion and removal of the unit (6) into and from the housing (1). Besides this, a fixture may be attached to one of the pair of frames (8) at each unit in order to position each unit (6) lengthwise of the housing (1), the fixture (16) being fixed through a bolt (18) and nut (19) to a partition (17) provided within the housing (1) to separate vertically the space therein. Each of the frames (8), as shown in FIG. 7, has a passage (20) for fluid medium and communicating with the closed interspace (B) therefor. The frame (8) is preferred to be arranged abutting against the frame of the adjacent unit so that the passages (20), (20) of both the units may communicate in alignment with each other to be kept air tight.

Each pair of frames (8), (8) and the predetermined number of plates (9) therebetween are previously assembled outside the housing (1) to thereby form the predetermined number of heat exchange units (6). The units (6) are inserted into the housing (1) and slightly urged and then the press lid (7) is attached to the opening end of housing (1), thus building up a compact plate heat exchanger of the invention.

In other words, since the plates (9) at each unit (6) are fully clamped up in assembly prior to insertion of the unit (6) into the housing (1), the interference of press lid (7) is only an amount corresponding to the sum of clearances possible to exist between each unit (6). As a result, the housing, in its turn, the entire heat exchanger, can be small-sized.

For example, a supplemental bar is connected to each guide bar (15) at the housing (1) and horizontally supported at one end by a stay or the like, thereby being substantially extendible outwardly of the housing (1). In this instance, after the lid (7) is removed from the housing (1), the unit (6) is movable horizontally along the supplemental bars. Or, wheels in place of the supplemental bars may be provided below the unit to thereby move the unit through the wheels rolling on rails laid on the floor.

Figure 3A:
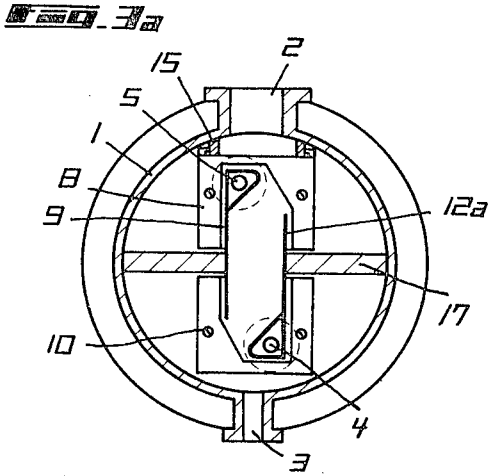
FIG. 3*a* is a sectional view of a partially opened interspace between the plates.
Figure 2:
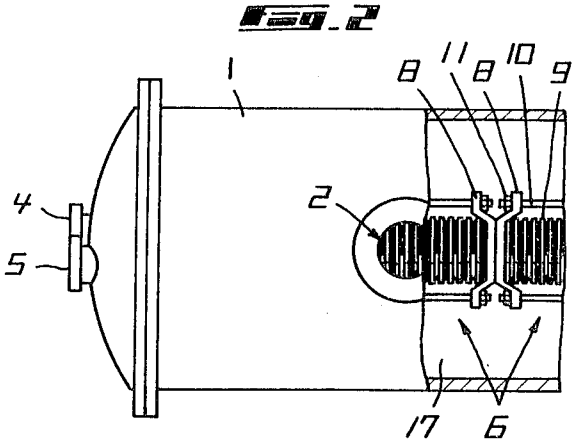
FIG. 2 is a partially plan view thereof, FIG. 3*a* and 3*b* being sectional views taken on Line III—III in FIG. 1.
Figure 1:
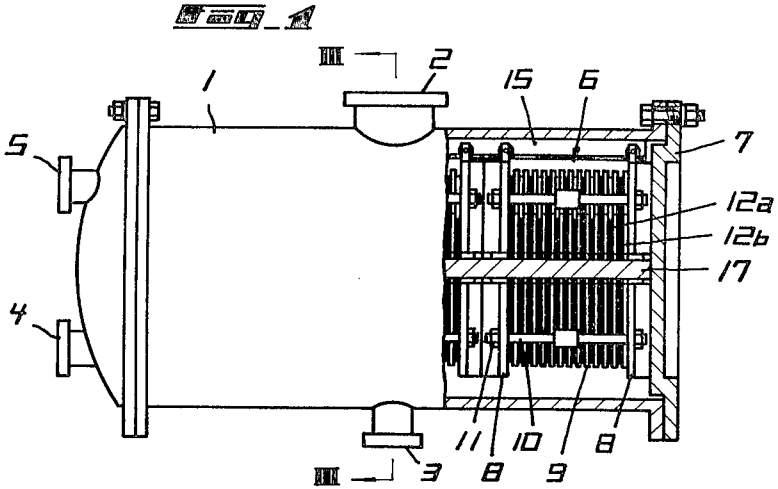
FIG. 1 is a partially sectional view of a plate heat exchanger of the invention.
Figure 8B:
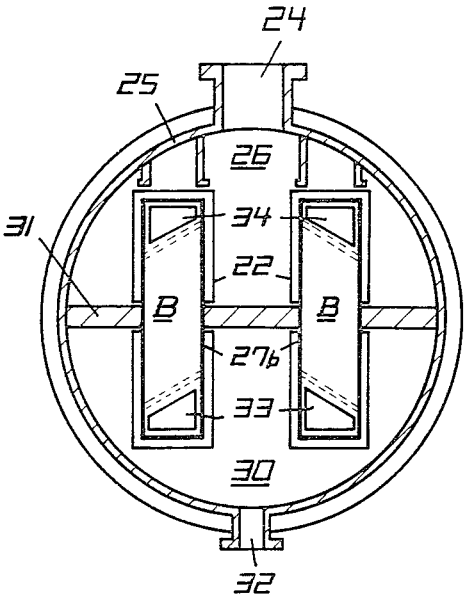
FIG. 8*a* and 8*b* are sectional views of a modified embodiment of the invention, corresponding to FIGS. 3*a* and 3*b*, and FIGS. 9*a* and 9*b* are sectional views of another modified embodiment, corresponding to FIGS. 3*a* and 3*b*.
Figure 8A:
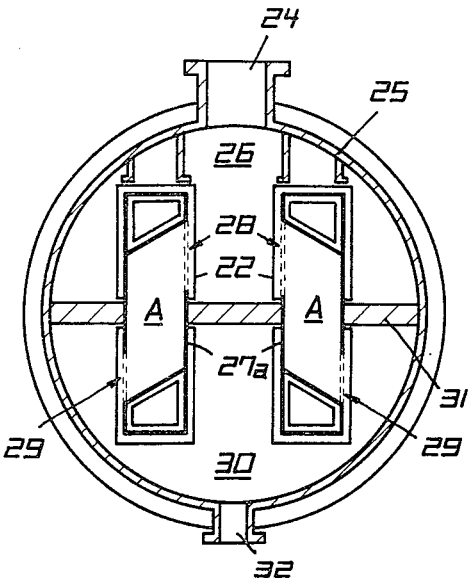

Referring to FIGS. 8*a* and 8*b*, a modified embodiment is shown in section, corresponding to FIGS. 3*a* and 3*b*. The plates (9) in FIGS. 3*a* and 3*b* are disposed in a single row, but those (22) in FIGS. 8*a* and 8*b* are in double rows. Such constitution has been developed to meet requirement of in a range in which the ratio of flow rate of air-to-fluid per unit areas of heat transfer, i.e., the flow rate of air, is several to several ten times that of fluid. The function of heat exchanger of the above constitution will be explained in view of, for example, condensation process through which air medium condenses as a result of heat exchange between the air and fluid media. Air medium, for example, steam, is, as shown in FIG. 8*a*, fed into the upper space (26) within a housing (25) from an air medium inlet (24) thereat and then divided laterally symmetrically and uniformly to be distributed through guide-in openings (28), (28) into interspaces (A), (A) defined by sealing strips (27*a*) between plates (22). The steam flows down within interspaces (A) along the heat transfer surfaces of plates (22) and then flows through guide-out openings (29) toward the lower space (30) isolated from the upper space (26) by means of partitions (31) and further toward an outlet (32). While, fluid medium, for example, cooling water, is fed through a fluid medium inlet (not shown in FIGS. 8*a* and 8*b*) provided at the end portion of housing (25), and then, as shown in FIG. 8*a*, flows through guide-in bores (33), (33) into the closed interspaces (B), (B) defined by sealing strips (27*b*) between the plates (22). The cooling water further flows upwardly toward guide-out bores (34), (34) and then discharged from the housing (1) through an outlet (not shown) provided at the end portion of housing (25). The steam within interspaces (A) and cooling water within those (B) are heat-exchanged with each other through the plate walls between the interspaces (A) and (B), whereby the steam condensates and resultant condensate is taken out together with disposed steam through the outlet (32).

Figure 9B:
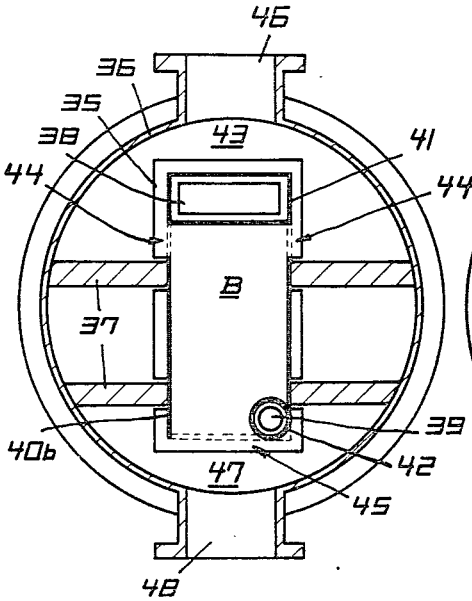
Figure 9A:
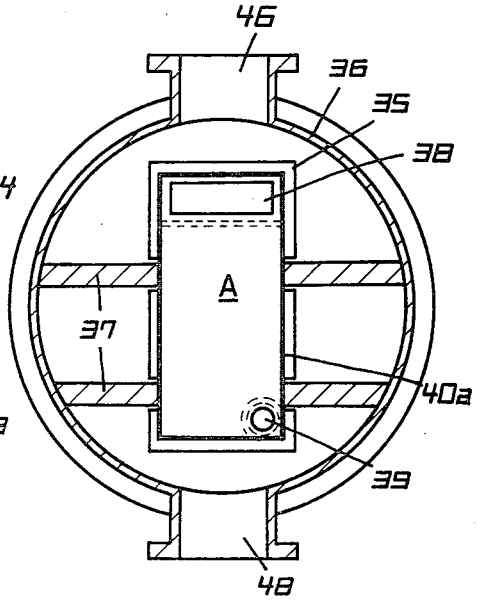

Reversely to the above, in the case that the flow rate of fluid medium exceeds that of air medium, another modified embodiment shown in FIGS. 9*a*and 9*b* is advantageous, for example, when steam is condensed. The flow rate of fluid medium is often several to several ten times larger than that of air medium in volume ratio. In this instance, the conventional supply method that fluid medium is allowed to flow through the closed interspaces as described in the former embodiment, when always, applied, lowers the efficiency for use of the plate surfaces as heat transfer surfaces (for example, because the openings (33), (34) for fluid medium are larger in opening area as shown in FIGS. 8*a* and 8*b*), thereby making it difficult to ensure the effective heat transfer surface.

In this embodiment, plates (35) are arranged in a single row and suspended within a horizontally arranged cylindrical housing (36) by means of the suitable number of guide plates (37) (two are shown). The plates (35), as the same as aforegoing, are clamped face to face through surrounding sealing strips (40*a*) and (40*b*), and interspaces (A) for air medium and those (B) for fluid medium are formed in alternate sequence between the plates (35). Each plate (35) is rectangular and has a top inlet (38) of a relatively larger opening area and for introducing air medium therein and a bottom round outlet for condensate. In order to connect heat transfer surfaces of the plates (35), sealing strips (40*a*) are arranged to surround the plate surfaces in sealing contact therewith to thereby define closed interspaces (A). On the other hand, the interspaces (B) through which the fluid medium flows are defined by sealing strips (40*b*) cut out in part, thereby communicating with the space within the housing (36) through the cutouts. It is to be noted that the interspaces (B) are isolated from the inlet (38) and outlet (39) for air medium by means of portions (41), (42) of sealing strips (40*b*). The sealing strips (40*b*) are, as shown, cut at the upper portion of each long side of rectangular plate (35) to provide an opening (44) for guiding-in fluid medium and connecting the upper space (43) within the housing (36) with the interspaces (B), and are cut at the lower short side to provide an opening (45) for guiding-out the fluid medium and for allowing the interspaces (B) to communicate with the lower space (47) within the housing (36).

In the aforesaid constitution, the fluid medium, e.g., cooling water, is fed into the upper space (43) from a top inlet (46) at the housing (36) and then diverges into each interspace (B) through the guide-in opening (44) to flow down along the heat transfer surface of plate (35). The fluid medium further flows into the lower space (47) through the guide-out opening (45) and then goes out through a bottom outlet (48) at the housing (36). While, the air medium, e.g., steam, is fed through an inlet (not shown in FIGS. 9*a* and 9*b*) provided at the end portion of housing (36), diverges into each interspace (A) through the guide-in bore (38) at each plate (35) in alignment and flows down along the heat transfer surface of each plate (35), and then is cooled by cooling water in the adjacent interspace (B) through the plate wall therebetween, thereby being condensed. As a result, the condensate together with disposed steam are discharged from the housing (36) through the guide-out bores (39) and an outlet (not shown) provided at the end portion of housing (36).

When the air medium is smaller in flow rate than the fluid medium (especially when steam condensates as aforegoing its volume reduces considerably), the air medium is fed into the closed interspaces (A), the supply of air medium into the closed interspaces reduces the areas of openings (38), (39) at the plate (35) in comparison with that of fluid medium of larger flow rate into the closed interspaces. Hence, such the supply of media is advantageous to ensure the effective heat transfer area at the plate surface. In addition, the opening areas of guide-in opening (44) and guide-out opening (45), are readily adjustable by optionally changing the cutout length at the sealing strip (40*b*) to thereby facilitate setting of flow rate of medium flowing through the interspaces (B), consequently, of the ratio of flow rate of both the media. Especially, the opening areas of guide-in and -out openings (44) and (45) are adjustable so that the fluid medium, when larger in flow rate, may be reduced in its pressure loss. Furthermore, the fluid medium flows downwardly along the plate (35) and not against gravity, thereby being advantageous from the viewpoint of reduction of pressure loss. Also, the guide-in bore (38) for air medium is provided approximately throughout width of heat transfer surface, whereby a change, such as expansion or contraction, is not found in the route through which the steam introduced into each interspace (A) leads to condensation, thus keeping minimum the pressure loss of steam within the interspaces (A).

As seen from the aforesaid description, the construction of heat exchanger of the invention is of course applicable similarly effectively for heat exchange by evaporation or fluid-to-fluid.

As many apparently widely different embodiments of this invention may be made without departing from the spirit and scope thereof, it is to be understood that the invention is not limited to the specific embodiments thereof except as defined in the appended claims.

What is claimed is:

1. A plate heat exchanger comprising; a cylindrical container having an inlet and an outlet for feeding and discharging one of both media respectively and an inlet and an outlet for the other, and being arranged axially horizontally to open at one end; a plurality of heat exchange units each including a pair of opposite frames and a pack of plate elements clamped face to face therebetween and being inserted in sequence into said container; and a press lid mounted to the open end of said container under condition of thrusting said plurality of heat exchange units.

2. A plate heat exchanger according to claim 1, characterized in that said plate elements are clamped face to face through surrounding sealing strips respectively to form between said plate elements interspaces through which the media flow, every second interspace among said interspaces being closed with respect to a space within said container and communicating with said inlet and outlet for the one medium, the remaining interspaces opening properly with respect to the space within said container by way of partial cutouts at said surrounding sealing strips to thereby communicate with said inlet and outlet for the other medium.

3. A plate heat exchanger according to claim 2, characterized in that the one medium is fluid medium and the other medium is air.

4. A plate heat exchanger according to claim 2, characterized in that the one medium is air medium and the other medium is fluid.

* * * * *